US008490606B2

(12) United States Patent
Zeitoun

(10) Patent No.: US 8,490,606 B2
(45) Date of Patent: Jul. 23, 2013

(54) PASSIVE RE-INDUCTION APPARATUS, SYSTEM, AND METHOD FOR RECIRCULATING EXHAUST GAS IN GASOLINE AND DIESEL ENGINES

(75) Inventor: Bassam Zeitoun, Tigard, OR (US)

(73) Assignee: New Vision Fuel Technology, Inc., Milwauki, OR (US)

( * ) Notice: Subject to any disclaimer, the term of this patent is extended or adjusted under 35 U.S.C. 154(b) by 0 days.

(21) Appl. No.: 13/039,919

(22) Filed: Mar. 3, 2011

(65) Prior Publication Data

US 2011/0146635 A1 Jun. 23, 2011

(51) Int. Cl.
*F02M 25/07* (2006.01)

(52) U.S. Cl.
USPC ..... 123/568.11; 165/141; 123/41.62

(58) Field of Classification Search
USPC ..... 123/568.11, 568.19, 703, 568.17, 123/41.62; 701/108–110; 165/41, 51, 52, 165/141, 154, 157, 168, 172, 174–177
See application file for complete search history.

(56) References Cited

U.S. PATENT DOCUMENTS

| | | | | |
|---|---|---|---|---|
| 3,368,345 | A | | 2/1968 | Walker |
| 3,412,722 | A | | 11/1968 | Epifanio, Sr |
| 3,481,144 | A | | 12/1969 | Morrell |
| 3,513,816 | A | | 5/1970 | Daigh |
| 3,618,576 | A | | 11/1971 | Dixon |
| 3,646,764 | A | | 3/1972 | Nakajima et al. |
| 3,739,583 | A | | 6/1973 | Tourtellotte et al. |
| 3,807,376 | A | | 4/1974 | Glockler et al. |
| 3,828,752 | A | | 8/1974 | Hioki et al. |
| 3,871,343 | A | | 3/1975 | Nagai et al. |
| 3,877,447 | A | | 4/1975 | Ross, Sr. |
| 3,893,435 | A | | 7/1975 | Konomi et al. |
| 3,934,564 | A | | 1/1976 | Barnert |
| 3,959,765 | A | * | 5/1976 | Stewart ..... 338/34 |
| 3,964,258 | A | | 6/1976 | Romano et al. |

(Continued)

FOREIGN PATENT DOCUMENTS

| | | | |
|---|---|---|---|
| EP | 1990511 | A | 11/2008 |
| JP | 09236053 | | 9/1997 |

(Continued)

OTHER PUBLICATIONS

International Search Report/Written Opinion, PCT/US2012/027013, Jan. 3, 2013, ISA/KR, Korean Intellectual Property Office, Daejeon, Republic of Korea.

*Primary Examiner* — John T. Kwon
*Assistant Examiner* — Johnny Hoang
(74) *Attorney, Agent, or Firm* — David A. Crowther

(57) ABSTRACT

An exhaust gas re-induction apparatus includes conduits and an outer housing, which receive exhaust gas from an exhaust system of an engine, and passively recirculate a portion of the gas to an air inlet of the engine while transferring another portion of the gas through orifices in the apparatus and via a return conduit to the exhaust manifold. An exchange of heat occurs between the exhaust gas, the various components and chambers of the re-induction apparatus, and the environment. Fuel efficiency is increased and harmful toxins and emissions are reduced. A system includes the re-induction apparatus and a recirculation conduit, which connects the re-induction apparatus to the air inlet of the engine before the vacuum, via a water separator or soot filter device depending on engine type. The amount of exhaust gas recirculated can essentially depend on the operating speed of the engine and the size dimensions of the apparatus.

11 Claims, 6 Drawing Sheets

U.S. PATENT DOCUMENTS

| | | | | |
|---|---|---|---|---|
| 4,009,700 | A | 3/1977 | Engels et al. | |
| 4,026,256 | A | 5/1977 | Fenn | |
| 4,029,472 | A * | 6/1977 | Micheli et al. | 422/108 |
| 4,044,738 | A | 8/1977 | Williams et al. | |
| 4,055,158 | A | 10/1977 | Marsee | |
| 4,066,413 | A * | 1/1978 | Segawa et al. | 422/98 |
| 4,091,615 | A | 5/1978 | Hayashi et al. | |
| 4,137,879 | A | 2/1979 | Kageyama et al. | |
| 4,206,173 | A * | 6/1980 | Yamaguchi et al. | 422/98 |
| 4,276,865 | A | 7/1981 | Hamai | |
| 4,356,806 | A | 11/1982 | Freesh | |
| 4,393,817 | A | 7/1983 | Lindberg | |
| 4,467,774 | A | 8/1984 | Becker et al. | |
| 4,503,813 | A | 3/1985 | Lindberg | |
| 4,617,795 | A | 10/1986 | Abthoff et al. | |
| 4,752,361 | A | 6/1988 | Gautschi | |
| 5,241,940 | A | 9/1993 | Gates, Jr. | |
| 6,094,909 | A | 8/2000 | Weber et al. | |
| 6,152,118 | A | 11/2000 | Sasaki et al. | |
| 6,173,567 | B1 | 1/2001 | Poola et al. | |
| 6,195,987 | B1 * | 3/2001 | Miyashita | 60/285 |
| 6,352,068 | B1 * | 3/2002 | Jacobsen | 123/585 |
| 6,739,177 | B2 * | 5/2004 | Sato et al. | 73/23.31 |
| 7,243,641 | B2 * | 7/2007 | Zukouski | 123/568.17 |
| 7,874,283 | B2 | 1/2011 | Farrow et al. | |
| 7,980,231 | B1 * | 7/2011 | Belter et al. | 123/568.11 |
| 2004/0154284 | A1 * | 8/2004 | Abdul-Khalek | 60/279 |
| 2006/0093879 | A1 * | 5/2006 | Yang et al. | 429/17 |
| 2006/0180224 | A1 * | 8/2006 | Berggren et al. | 137/892 |
| 2007/0271920 | A1 * | 11/2007 | Marsal et al. | 60/605.2 |
| 2008/0307770 | A1 | 12/2008 | Brahma et al. | |
| 2009/0188235 | A1 | 7/2009 | Robel et al. | |
| 2009/0241515 | A1 * | 10/2009 | Cardno | 60/278 |
| 2009/0308613 | A1 * | 12/2009 | Smith | 166/305.1 |
| 2010/0065029 | A1 * | 3/2010 | Currie et al. | 123/568.17 |
| 2010/0293943 | A1 * | 11/2010 | Teng et al. | 60/602 |
| 2011/0030372 | A1 * | 2/2011 | Ooshima et al. | 60/605.2 |
| 2011/0183274 | A1 * | 7/2011 | Bahn | 431/2 |

FOREIGN PATENT DOCUMENTS

| | | | |
|---|---|---|---|
| JP | 9236053 | A | 9/1997 |
| JP | 2001132442 | A * | 5/2001 |
| JP | 2006132470 | A | 5/2006 |
| JP | 2011112023 | A | 6/2011 |
| WO | 2004071646 | A | 8/2004 |

* cited by examiner

PASSIVE RE-INDUCTION APPARATUS, SYSTEM, AND METHOD FOR RECIRCULATING EXHAUST GAS IN GASOLINE AND DIESEL ENGINES

TECHNICAL FIELD

This disclosure relates to increasing fuel efficiency of engines and reducing harmful emissions thereof, and, more particularly, to a method, system, and re-induction apparatus for recirculating exhaust gas in gasoline engines, diesel engines, and/or similar engines or motors.

BACKGROUND

Gasoline and diesel engines are ubiquitous and vital to the economies of nations throughout the world. Vehicle engines, compressor engines, aircraft engines, boat or ship engines, heavy duty diesel truck engines and other heavy duty diesel equipment, engines, motors, and the like, while crucial to the advancement of modern society, share certain traits: they depend on increasingly expensive oil and fuel resources, and can generate harmful toxins and emissions.

Conventional attempts to increase fuel efficiency and reduce emissions have inevitably increased the sheer complexity of gasoline and diesel engines, and their related control systems, which has resulted in significant cost increases. Such "built-in" complexity and associated costs are most often borne by the bottom line of companies and the pocket book of consumers. While any approach to improve fuel efficiency or reduce harmful releases of toxins is laudable, if the costs for doing so out-weigh the benefits of implementation, then the adoption rate might be slow. Conversely, if the benefits outweigh the costs, this, in turn, would inexorably lead to wider adoption of the technology, and as a result, a beneficial result for society.

Generally, attempts to improve engine efficiencies have typically focused on the addition of complex control systems such as fuel injection systems, computerized monitoring systems, turbo charged systems, hybridization, and other tightly controlled and coordinated valve systems. Even where gains are made using such systems, unnecessary difficulty, complexity and expenditures are usually at least some of the outcomes. Moreover, government regulations are generally becoming increasingly stringent in the areas of clean air, required fuel economies, and so forth, and the conventional approaches in the art are likely insufficient to address current and future concerns in this area. Accordingly, a need remains for an improved apparatus, system, and method for improving fuel efficiency and reducing harmful emissions in gasoline and diesel engines.

The foregoing and other features of the invention will become more readily apparent from the following detailed description, which proceeds with reference to the accompanying drawings.

DETAILED DESCRIPTION

Figure 1:
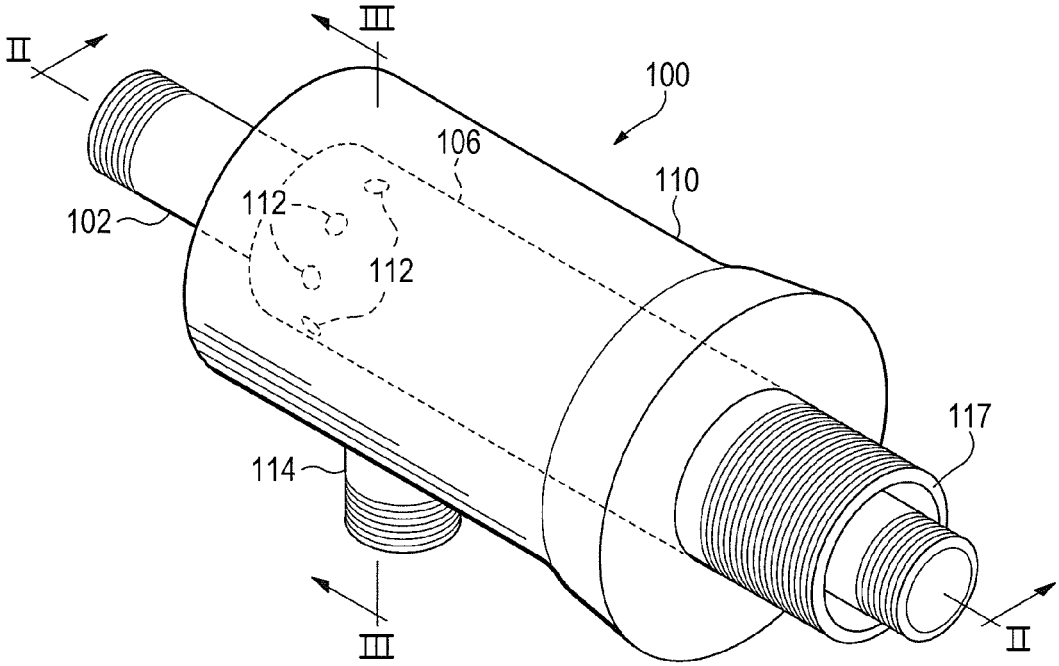
FIG. 1 illustrates an exhaust gas re-induction apparatus according to an example embodiment of the present invention.
Figure 2:
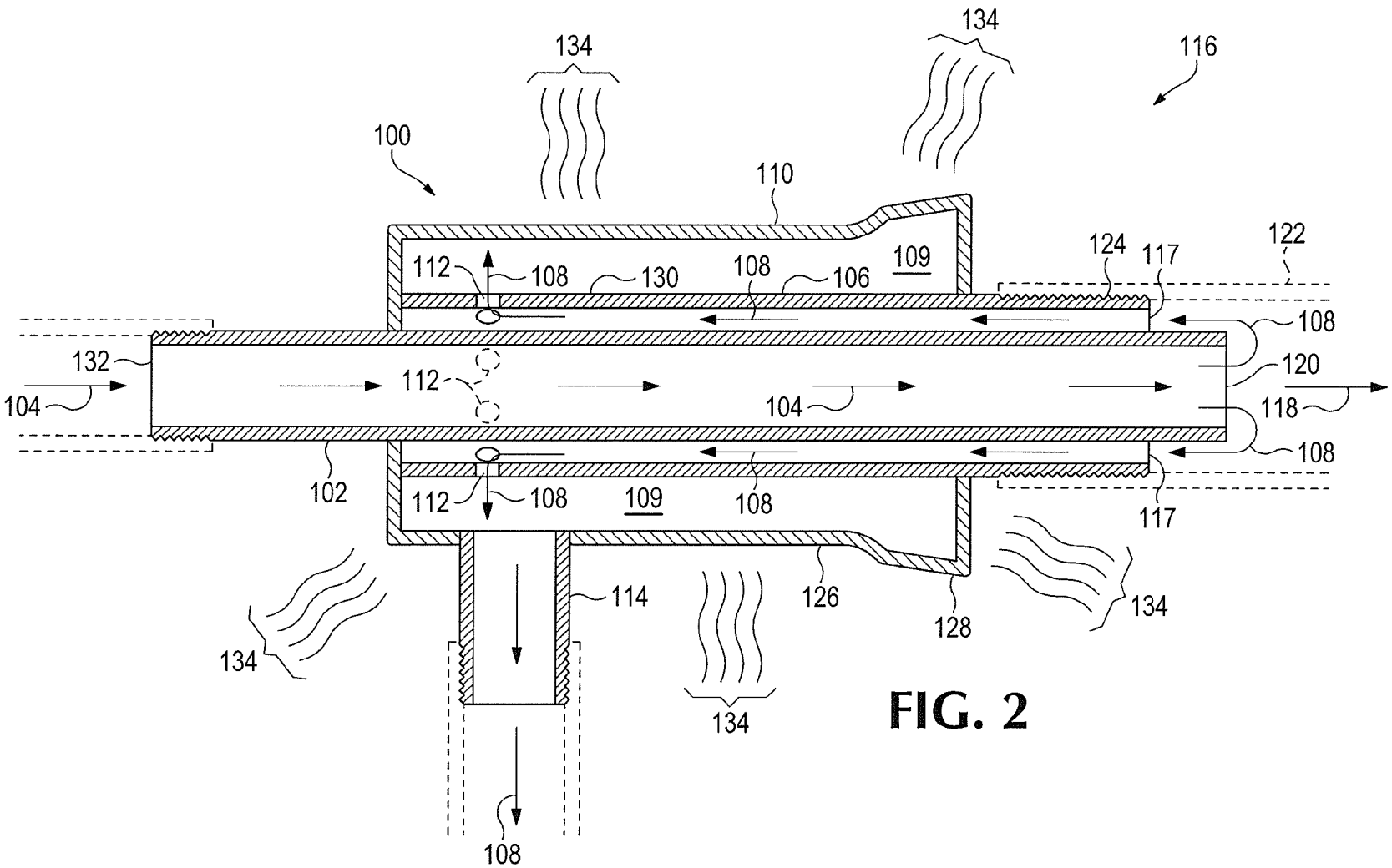
FIG. 2 illustrates a cross section of the exhaust gas re-induction apparatus of FIG. 1 taken along lines II-II.
Figure 3:
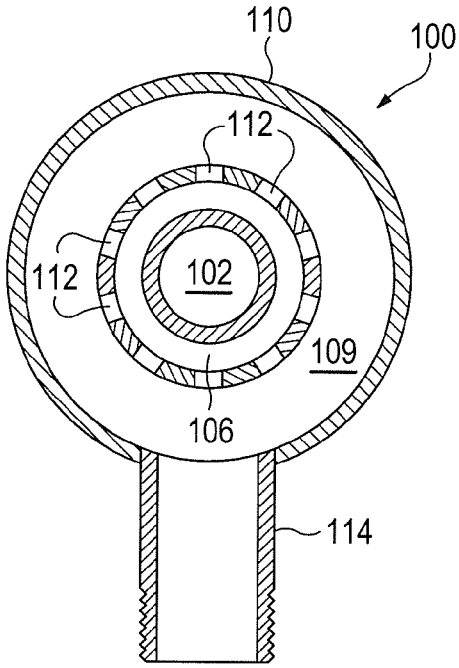
FIG. 3 illustrates a cross section of the exhaust gas re-induction apparatus of FIG. 1 taken along lines III-III.

FIG. 1 illustrates an exhaust gas re-induction apparatus 100 according to an example embodiment of the present invention. FIG. 2 illustrates a cross section of the exhaust gas re-induction apparatus of FIG. 1 taken along lines II-II. FIG. 3 illustrates a cross section of the exhaust gas re-induction apparatus of FIG. 1 taken along lines III-III. Reference is now made to FIGS. 1 through 3.

The exhaust gas re-induction apparatus includes an inner conduit 102. The inner conduit 102 transfers exhaust gas 104 in a direction indicated by arrows 104. A central conduit 106 is concentrically arranged relative to the inner conduit 102. The central conduit 106 guides a first portion 108 of the exhaust gas in a direction indicated by arrows 108, opposite the first directional flow of the exhaust gas within the apparatus.

An outer housing 110 is coupled to the inner and central conduits 102, 106, and is concentrically arranged relative to the inner and central conduits, as illustrated in the Figures. The outer housing 110 receives the first portion 108 of the exhaust gas from the central conduit 106 through a plurality of orifices 112 disposed in the central conduit 106. Eventually, a return conduit 114 receives the first portion 108 of the exhaust gas from the plurality of orifices 112, and guides the first portion 108 of the exhaust gas to an exhaust system of an engine (not shown). The inner conduit 102 passes a second portion 118 of the exhaust gas for recirculation to the engine.

Each of the conduits 102, 106, the outer housing 110, and the return conduit 114 can be constructed of steel, aluminum, chrome, titanium, carbon fiber, or any other suitable metal or material capable of withstanding high-temperature exhaust gases produced by an engine. Preferably, the conduits are substantially cylindrical. For example, the conduits can be constructed of different sized pipes or portions of pipes and can be coupled to the outer housing by means of welding or other suitable coupling means. It should be understood that the apparatus 116 can be comprised of a single contiguous construction without the need for welding or other coupling means. It should also be understood that the conduits need not be cylindrical, but can be rectangular or in the shape of a box, or any other suitable shape for transferring the exhaust gas between the different sections of the apparatus 100.

The inner and central conduits 102, 106 generally extend beyond the ends of the outer housing 110, and an exhaust gas input 108 of the central conduit 106 is proximally located to an exhaust gas output 120 of the inner conduit 102. The diameter of a cross section of the inner conduit 102 is less than the diameter of a cross section of the central conduit 106, and the inner conduit 102 extends through the central conduit 106 for at least the length of the central conduit 106.

The outer housing 110 forms a heat exchange chamber 109 between the inner walls of the outer housing 110 and the outer walls of the central conduit 106. The inner conduit 102, the central conduit 106, and the outer housing 110 including the heat exchange chamber 109 are structured to exchange heat 134 one with another and with the atmosphere 116 external of the re-induction apparatus 100, and are structured to alter the temperature of the exhaust gas 104 based on the quantity of exhaust gas flowing therein. The result is a beneficial reduction or increase in the temperature of the exhaust gas, depending on the use scenario and/or external environment.

For instance, in cold weather environments or extreme cold air environments, the heat exchange chamber 109 operates in cooperation with the other elements of apparatus 100 to heat up the exhaust gas due to its interaction with previously heated elements of the apparatus 100. For example, the first portion 108 of the exhaust gas routed through the heat exchange chamber 109 of the apparatus 100 can be heated prior to exiting through the return conduit 114. At least some of the exhaust gas transferred to the exhaust system through the return conduit 114 circulates back to the input 132 of the inner conduit 102 in a temperature conditioned state higher than its previous temperature state. This exhaust gas can be mixed with other exhaust gas coming directly from the exhaust system of the engine, and then recirculated as the second portion 118 of the exhaust gas to the engine. This enhances the ability of the engine to operate smoothly without losing power in all modes including idle, acceleration, and cruising, even in colder temperatures, while recirculating a portion of the exhaust gas for a reduction in emissions and an increase in fuel efficiency.

In normal, warm, or hot weather environments, the heat exchange chamber 109 operates in cooperation with the other elements of apparatus 100 to reduce the temperature of the exhaust gas. The temperature of exhaust gas produced by an engine can be up to 400 degrees Fahrenheit or higher. Recirculating such high-temperature exhaust gas to an engine can potentially damage engine components, and so in some operating conditions it is advantageous to reduce the temperature of the exhaust gas prior to recirculation to the engine. In such environments, the temperature of the first portion 108 of the exhaust gas routed through the heat exchange chamber 109 is reduced prior to exiting through the return conduit 114. At least some of the exhaust gas transferred to the exhaust system through the return conduit 114 circulates back to the input 132 of the inner conduit 102 in a temperature conditioned state lower than its previous temperature state. This exhaust gas can be mixed with other exhaust gas coming directly from the exhaust system of the engine, and then recirculated as the second portion 118 of the exhaust gas to the engine.

In this manner, the exhaust gas re-induction apparatus 100 acts as a temperature moderator or leveler in both cold and hot temperature environments. When appropriate, the temperature of the exhaust gas is increased by the re-induction apparatus. Conversely, heat is released to the environment and the temperature of the exhaust gas is reduced in other environments. Such heat exchange features of the re-induction apparatus function to enhance the reliability and efficiency of the engine when recirculating portions of the exhaust gas thereto.

A recirculation conduit 122 is coupled to an end 124 of the central conduit 106 and receives and transfers the second portion 118 of the exhaust gas to the engine (not shown) for recirculation of the second portion 118 of the exhaust gas. The second portion 118 of the exhaust gas transferred through the recirculation conduit 122 corresponds to between about 5% (percent) to 20% (percent) of the total exhaust gas produced by the engine over a given period of time, thereby increasing the fuel efficiency and reducing the emissions of the engine. It should be understood that while about 5% to 20% is the preferred amount of exhaust gas to recirculate using the re-induction apparatus 100, other percentages of exhaust gas can be recirculated, such as between about 3% to 25%, 1% to 30%, 5% to 50%, and 1% to 100% of the exhaust gas.

The exhaust gas re-induction apparatus 100 is a passive and non-controlled apparatus. In other words, the re-induction apparatus 100 need not be dependent on computerized systems, monitoring systems, control valves, solenoids, switches, electrical power, relays, and the like, which are not required for the proper functioning and operation of the apparatus or system. The quantity of exhaust gas passed through the inner conduit 102 for recirculation to the engine and the quantity of gas exhaust transferred through the return conduit 114 are essentially dependent only on the operating speed of the engine and the size dimensions of the re-induction apparatus 100.

Each component of the exhaust gas re-induction apparatus 100 is passive and non-controlled. In some embodiments, the inner conduit 102, the central conduit 106, the outer housing 110, and the return conduit 114 have always-open passages in which the exhaust gas can flow at different rates depending on the operating speed of the engine and the size dimensions of the inner conduit 102, the size dimensions of the central conduit 106, the size dimensions of the outer housing 110, the size dimensions of the return conduit 114, and the size dimensions of each of the plurality of orifices 112.

Although the re-induction apparatus 100 can be constructed and arranged in a variety of shapes or forms, in an example embodiment, the outer housing 110 is substantially bell-shaped including at least a first section 126 having a first diameter and a second section 128 having a second diameter, wherein the walls of the outer housing 110 are tapered between the first and second sections. The orifices 112 are spaced apart one from another and circumferentially disposed around a section of the central conduit 106. The section having the circumferentially disposed orifices is located toward an end 130 of the central conduit 106 opposite an exhaust gas output 120 of the inner conduit 102.

In some embodiments, the central conduit 102 includes an annular shaped exhaust gas input 117 offset from the exhaust gas output 120 of the inner conduit 102. The inner conduit 102 includes an exhaust gas input 132, which can be coupled to the exhaust system of the engine. An end 124 of the central conduit 106 associated with the exhaust gas input 117 of the central conduit 106 can be coupled to a recirculation conduit 122. The exhaust gas output 120 of the inner conduit 102 is contained within the recirculation conduit 122 for recirculation of the second portion 118 of the exhaust gas through the engine.

Figure 4:
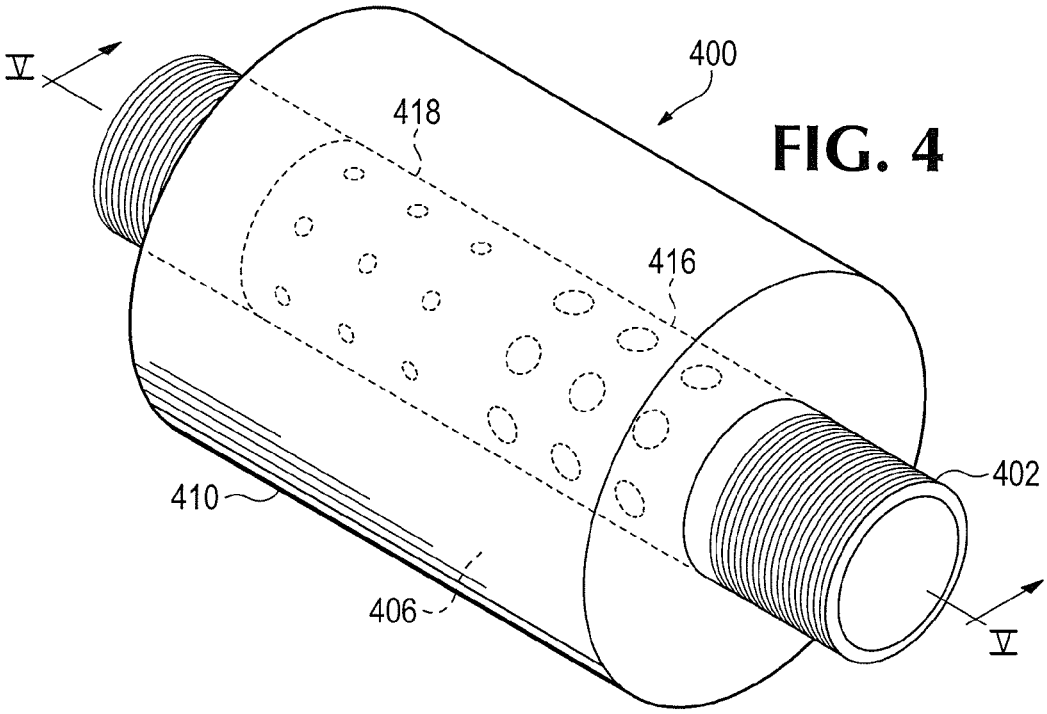
FIG. 4 illustrates a soot filter device according to an example embodiment of the invention.
Figure 5:
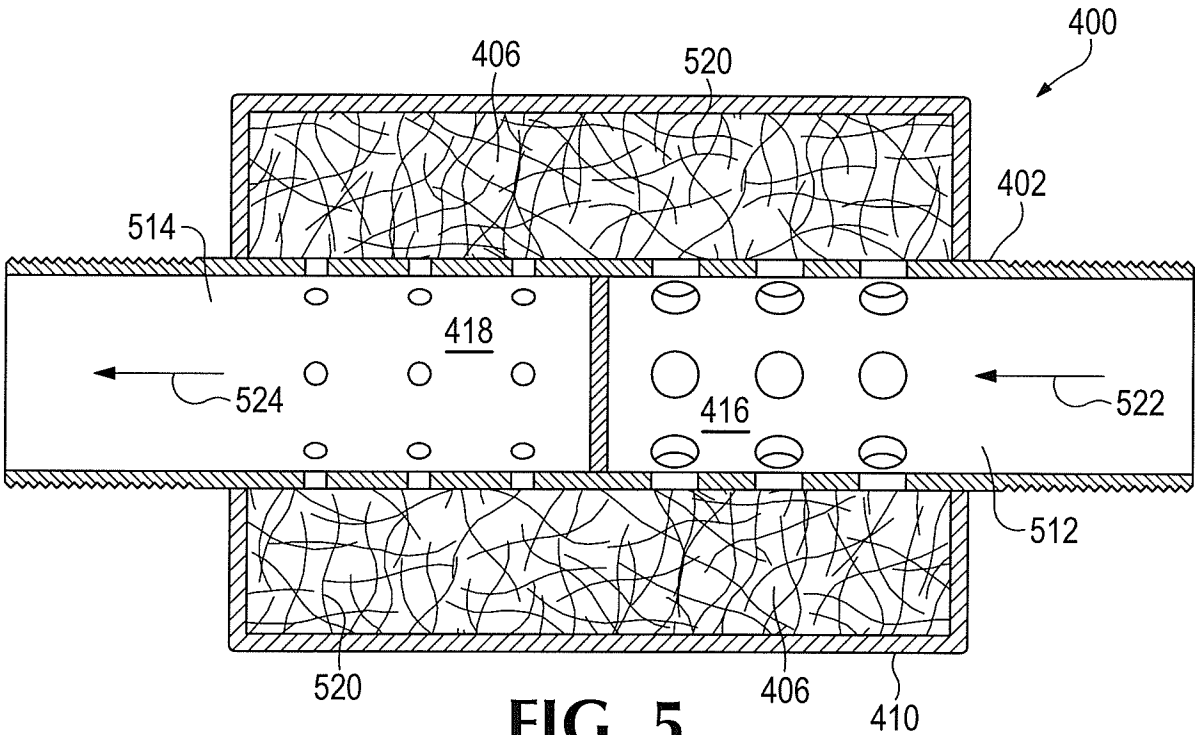
FIG. 5 illustrates a cross section of the soot filter device of FIG. 4 taken along lines V-V.

FIG. 4 illustrates a soot filter device 400 according to an example embodiment of the invention. FIG. 5 illustrates a cross section of the soot filter device 400 of FIG. 4 taken along lines V-V. Reference is now made to FIGS. 4 and 5.

The soot filter device 400 is structured to remove soot from the recirculated exhaust gas 522, particularly for diesel engines, heavy duty diesel trucks, and heavy duty diesel equipment, to prevent soot from being circulated to the engine. In some example embodiments, the soot filter device 400 includes an inner conduit 402, an outer housing 410, and a filter chamber 406. The filter chamber 406 is arranged between the inner conduit 402 and the outer housing 410. The inner conduit 402 of the soot filter device 400 includes an entry chamber 512 and an exit chamber 514 for receiving and guiding the exhaust gas through the filter chamber 406.

The entry chamber 512 includes first orifices 416 each having a first size, the orifices spaced apart one from another and circumferentially disposed around one or more sections of the inner conduit 402 within the entry chamber 512. The exit chamber 514 includes second orifices 418 each having a second size, the second orifices spaced apart one from another and circumferentially disposed around one or more sections of the inner conduit 402 within the exit chamber 514. In some embodiments, the first size of the first orifices 416 is larger than the second size of the second orifices 418.

The filter chamber 406 includes fibers 520 embedded therein, and is structured to receive recirculated exhaust gas 522 from the entry chamber 512 through the first orifices 416, filter the recirculated exhaust gas 524 to remove soot therefrom, and transfer the filtered exhaust gas 524 to the exit chamber 514 through the second orifices 418.

Figure 6:
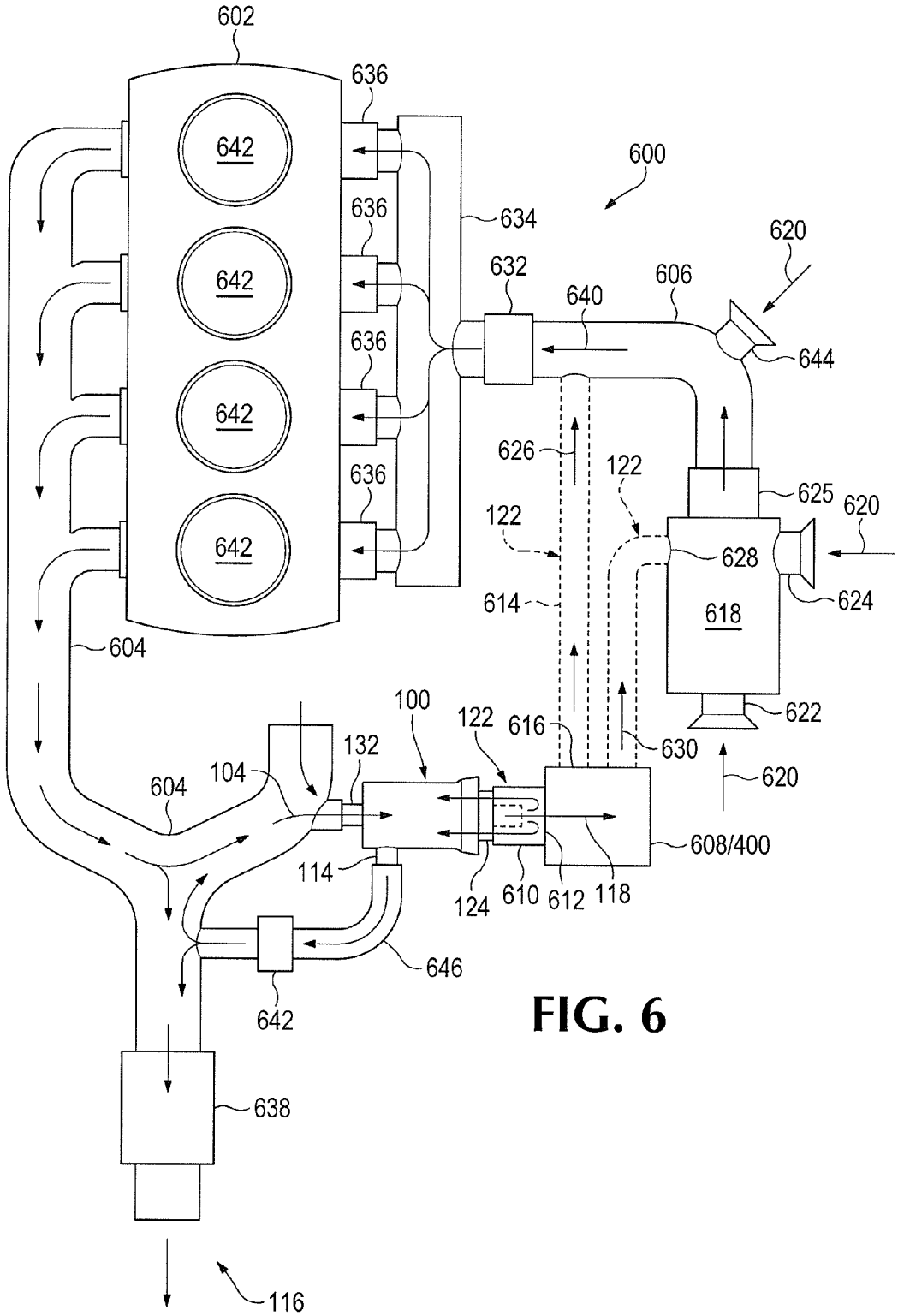
FIG. 6 illustrates an exhaust gas passive re-induction system including the exhaust gas re-induction apparatus of FIG. 1 according to another example embodiment of the present invention.

FIG. 6 illustrates an exhaust gas passive re-induction system 600 including the exhaust gas re-induction apparatus 100 of FIG. 1 according to another example embodiment of the present invention. The exhaust gas passive re-induction system 600 includes the exhaust gas re-induction apparatus 100 coupled to an exhaust manifold 604 of an engine 602. While the term "engine" is used herein, it should be understood that motors or other similar devices can be used in combination with any of the embodiments or elements of the invention as discussed herein. Although illustrated here as an engine having four cylinders 642, the engine 602 can be of any size and type, and have any number of cylinders. Moreover, the engine can consume gasoline or diesel engine fuels, among other suitable fuels. The engine 602 can be used in a vehicle, a compressor, a boat or ship, an aircraft, a heavy duty diesel truck, and/or other equipment having need for an engine, among other suitable engine types.

The exhaust gas re-induction apparatus 100 receives exhaust gas 104 from the exhaust manifold 604 of the engine 602, and recirculates a portion 118 of the exhaust gas to an air inlet 606 of the engine 602. The recirculation conduit 122 connects the exhaust gas re-induction apparatus 100 to the air inlet 606 of the engine 602. The engine 602 can include a throttle valve 632, an air intake manifold 634, a carburetor 636 and/or fuel injection component 636. In some embodiments, the recirculation conduit 122 is directly connected to the air inlet 606 of the engine 602. In other words, the recirculation conduit 122 is connected to the air inlet 606 of the engine before the vacuum of the engine 602, and can connect to the air inlet 606 anywhere between the throttle valve 632 and the mass air flow sensor (MAS) 625 or manifold absolute pressure sensor (MAP) 625. Alternatively, or in addition to, the recirculation conduit 122 is connected to the air inlet 606 through an air filter 618. Whether connected directly to the air inlet 606 or through the air filter 618, the recirculation conduit 122 is preferably connected to the air inlet 606 upstream of the throttle valve 632, the air intake manifold 634, and the carburetor 636 or the fuel injection component 636. The quantity of exhaust gas recirculated to the air inlet 606 of the engine 602 from the re-induction apparatus 100 is essentially dependent on the operating speed of the engine 602 and the size dimensions of the re-induction apparatus 100.

For example, when the engine 602 is operating at a relatively low speed such as at an idle speed, the amount of exhaust gas 118 recirculating to the engine 602 is reduced so that the engine continues to operate smoothly. The majority of the exhaust gas passing through the re-induction apparatus 100 returns to the exhaust manifold 604 of the engine 602 through the return conduit 114, thereby relieving pressure. When the operating speed of the engine increases to a higher speed, for example, associated with an accelerating or cruising speed, so too does the amount of exhaust gas 118 recirculating to the engine 602, as well as the amount of exhaust gas relieved through the return conduit 646. Furthermore, the re-induction apparatus 100 can be constructed to have a particular size relative to the size of the engine, so that for smaller engines, less exhaust gas is recirculated, and for larger engines, more exhaust gas is recirculated, as further explained below.

More specifically, when the operating speed of the engine 602 corresponds to an idling speed, the re-induction apparatus 100 is structured to recirculate a first quantity of exhaust gas 118 to the air inlet 606 of the engine 602. When the operating speed of the engine 602 corresponds to a second operating speed greater than the idling speed, such as speeds associated with an acceleration phase of the engine, the re-induction apparatus 100 is structured to recirculate a second quantity of exhaust gas 118 to the air inlet 606 of the engine 602. When the operating speed of the engine 602 corresponds to a third operating speed, such as a cruising speed, which is greater than the idling speed and the second operating speed, the re-induction apparatus 100 is structured to recirculate a third quantity of exhaust gas 118 to the air inlet 606 of the engine 602. The second quantity of exhaust gas is greater than the first quantity of exhaust gas, and the third quantity of exhaust gas is greater than each of the first and second quantities of exhaust gas, each measured over a given period of time.

The return conduit 114 receives the first portion 108 of the exhaust gas and guides the first portion 108 of the exhaust gas to the exhaust manifold or system 604 of an engine 602. The inner conduit 102 of the re-induction apparatus 100 passes a second portion 118 of the exhaust gas through either a soot filter device 400 or a water separator 608, depending on the engine type, as further explained below, before being recirculated to the engine 602. The exhaust gas that "spills over" through the return conduit 114 is either recirculated back to the input 132 of the re-induction apparatus 100, or is transferred to the catalytic converter 638, and eventually expelled through a muffler and/or tailpipe (not shown) of the engine 602. It should be understood that the engine 602 need not include a catalytic converter, muffler, or tailpipe, and reference is made to these components for exemplary purposes only.

The recirculation conduit 122 can be coupled to an end 124 of the central conduit 106 and can receive and transfer the second portion 118 of the exhaust gas to the engine 602 for recirculation of the second portion 118 of the exhaust gas. The second portion 118 of the exhaust gas that is transferred through the recirculation conduit 122 increases the fuel efficiency and reducing the emissions of the engine, as mentioned above.

The exhaust gas re-induction apparatus 100 is a passive and non-controlled apparatus. In other words, the re-induction apparatus 100 need not be dependent on computerized or other monitoring systems, control valves, solenoids, switches, electrical power, relays, and the like, which are not required for the proper functioning and operation of the apparatus. The quantity of exhaust gas passed through the inner conduit 102 for recirculation to the engine and the quantity of gas exhaust transferred through the return conduit 114 are essentially dependent only on the operating speed of the engine and the size dimensions of the re-induction apparatus 100.

It should be understood that other features of the system 600 can affect the quantity of the exhaust gas recirculated to the engine 602, such as the size dimensions of the engine 602, exhaust manifold 604, and other sections of the system such as the recirculation conduit 122 and the water filter 608 or soot filter device 400. One of the inventive aspects disclosed, however, is that the quantity of exhaust gas recirculated to the engine 602 is primarily dependent on the operating speed of the engine 602 and the size dimensions of the components of the re-induction apparatus 100.

Each component of the exhaust gas re-induction apparatus 100 is passive and non-controlled. In some embodiments, the inner conduit 102, the central conduit 106, the outer housing 110, and the return conduit 114 have always-open passages in which the exhaust gas can flow at different rates depending essentially on the operating speed of the engine and the size dimensions of the inner conduit 102, the size dimensions of the central conduit 106, the size dimensions of the outer housing 110, the size dimensions of the return conduit 114, and the size dimensions of each of the plurality of orifices 112.

The inner conduit 102 includes an exhaust gas input 132, which can be coupled to the exhaust system or manifold 604 of the engine. The end 124 of the central conduit 106 associated with the exhaust gas input 117 of the central conduit 106 can be coupled to the recirculation conduit 122. The exhaust gas output 120 of the inner conduit 102 is contained within the recirculation conduit 122 for recirculation of the second portion 118 of the exhaust gas through the engine 602.

Moreover, the return conduit 114 is coupled to the exhaust system or manifold 604 via a connecting conduit 646. The connecting conduit 646 can include a one-way valve 642 structured to permit one-way passage of the first portion 108 of the exhaust gas to the exhaust system or manifold 604.

Where the engine 602 is a gasoline powered engine, or otherwise uses gasoline or primarily gasoline as a fuel, a water separator 608 can be disposed in the path between the exhaust gas re-induction apparatus 100 and the air inlet 606. In some embodiments, the recirculation conduit 122 includes a first section 610 connecting the exhaust gas re-induction apparatus 100 to an input 612 of the water separator 608 and a second section 614 connecting an output 616 of the water separator 608 to the air inlet 606. The water separator 608 is structured to remove water particles from the recirculated exhaust gas prior to being recirculated to the engine 602.

Where the engine 602 is a diesel powered engine, or otherwise uses diesel fuel or primarily diesel as a fuel, a soot filter device 400 can be disposed in the path between the exhaust gas re-induction apparatus 100 and the air inlet 606. In some embodiments, the recirculation conduit 122 includes a first section 610 connecting the exhaust gas re-induction apparatus 100 to an input 612 of the soot filter device and a second section 614 connecting an output 616 of the soot filter device 400 to the air inlet 606. The soot filter device 400 is structured to remove soot from the recirculated exhaust gas, as explained in detail above.

The exhaust gas passive re-induction system 600 can further include an air filter 618 to receive and filter air 620 from the atmosphere. The air filter 618 includes a first opening 622 at one end thereof and can include a second opening 624 toward an opposite end thereof. The air filter 618 is structured to filter air 620 received through the first and second openings. The air inlet 606 of the engine 602 is structured to receive a mixture 640 of (a) filtered air received through the first opening 622 of the air filter, (b) filtered air received through the second opening 624 of the air filter, and (c) exhaust gas 626 from the recirculation conduit 122.

In some embodiments, the air filter 618 includes a third opening 628, and the recirculation conduit 122 can connect the exhaust gas re-induction apparatus 100 to the third opening 628 of the air filter 618. In this example, the air filter 618 is structured to filter the exhaust gas 630 received through the third opening 628, and the air inlet 606 of the engine 602 receives a mixture 640 of (a) filtered air received through the first opening 622 of the air filter, (b) filtered air received through the second opening 624 of the air filter, and (c) filtered exhaust gas 630 received through the third opening 628 of the air filter 618 from the recirculation conduit 122.

In some embodiments, the air inlet 606 includes an adjustable air inlet opening 644 in which an adjustable quantity of air 620 is received and mixed with the recirculated portion 118 of the exhaust gas. The air intake manifold 634 of the engine 602 can receive the mixed air 620 and recirculated portion 118 of the exhaust gas. The adjustable air inlet opening 644 can be adjusted manually or automatically, and can optionally include a filter component.

Figure 7:
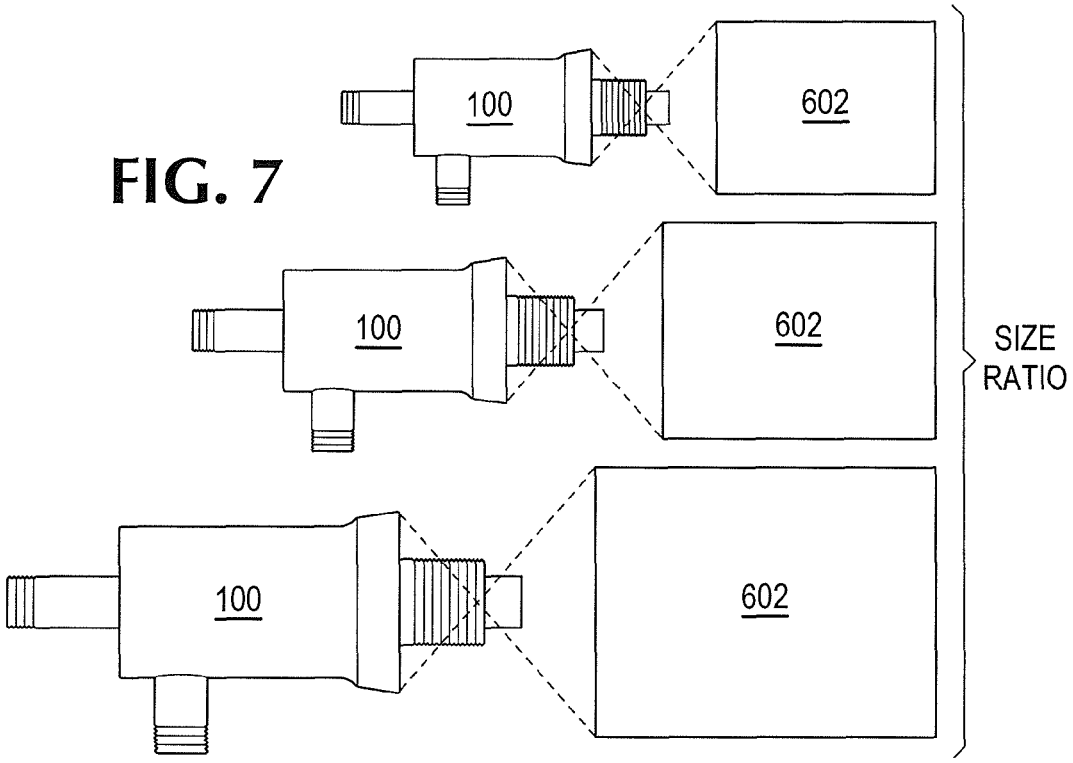
FIG. 7 illustrates an example of a size ratio between different dimensional aspects of the exhaust gas re-induction apparatus of FIG. 1 relative to different dimensional aspects of engines according to some example embodiments of the present invention.

FIG. 7 illustrates an example of a size ratio between different dimensional aspects of the exhaust gas re-induction apparatus 100 of FIG. 1 relative to different dimensional aspects of engines 602 according to some example embodiments of the present invention. Different sized engines result in different capabilities. As a result, the size of the re-induction apparatus and/or the connection point of the recirculation conduit can be selected based on the size and/or capabilities of the engine, thereby introducing recirculated exhaust gas into the air inlet of the various sized engines at a rate that is most efficient for that particular engine. As mentioned above, preferably about 5% to 20% of the total exhaust gas produced by an engine is to be recirculated to the engine. Such recirculation can be accomplished by simply referencing the size ratio between the re-induction apparatus 100 and the engine, and adapting the system accordingly, without the need for expensive and complex control systems.

Figure 8:
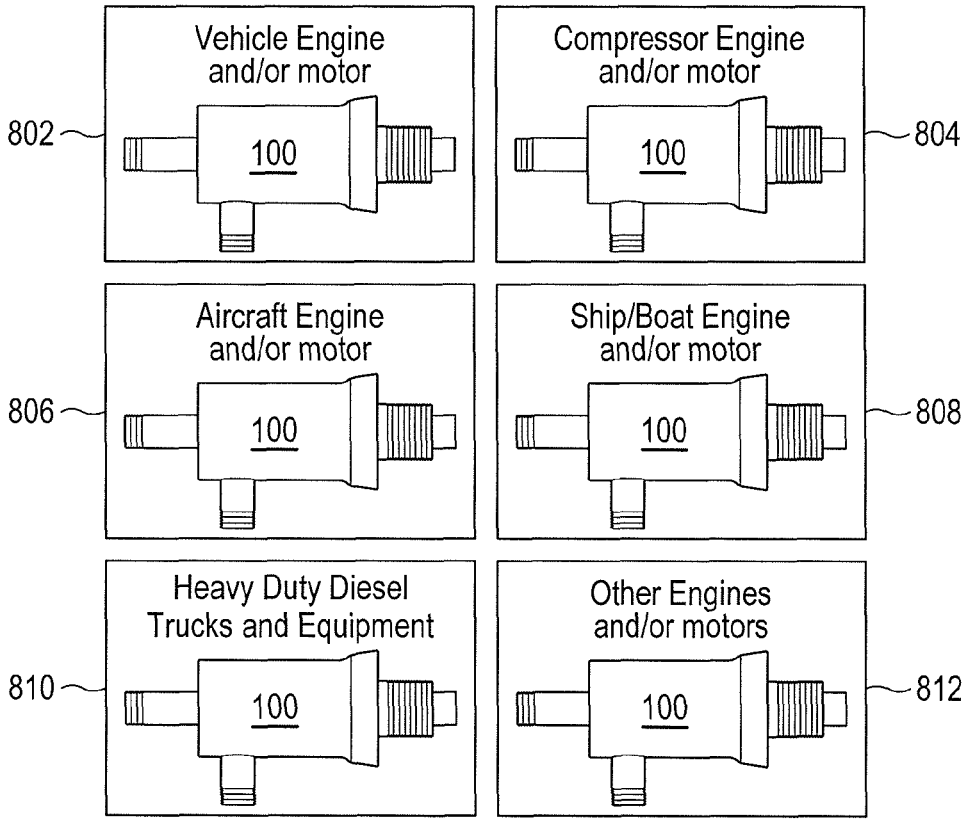
FIG. 8 illustrates a variety of engine types in which the exhaust gas re-induction apparatus of FIG. 1 can be incorporated according to some example embodiments of the present invention.

FIG. 8 illustrates a variety of engine and/or motor types in which the exhaust gas re-induction apparatus 100 of FIG. 1 can be incorporated according to some example embodiments of the present invention. The exhaust gas re-induction apparatus 100 is operable with at least one of a vehicle engine and/or motor 802, a compressor engine and/or motor 804, an aircraft engine and/or motor 806, a boat or ship engine and/or motor 808, a heavy duty diesel truck 810, and/or diesel equipment 810. Persons having skill in the art will recognize that the re-induction apparatus 100 can also be adapted for use with other engines and/or motors 812 not specifically mentioned herein.

Using the exhaust gas re-induction apparatus 100 results in an increase in fuel efficiency of around 20%-30% (percent) and a reduction in harmful emissions of up to 80% (percent). In some embodiments, the reduction in harmful emissions is around 80% (percent) or more. In some embodiments, the reduction in harmful emissions is between 70% (percent) and 90% (percent). Recirculation of the exhaust gas occurs passively using the re-induction apparatus without adding significant cost or control complexity to the engine system. The exhaust gas passive re-induction system as set forth herein operates in cold, warm, or hot weather, and at any operating speed of the engine including an idle speed. The exhaust gas re-induction apparatus prevents overheated gas from recirculating through the engine and also increases the temperature of the exhaust gas in cold weather to ensure smooth operation of the engine.

Although the foregoing discussion has focused on particular embodiments, other configurations are contemplated. In particular, even though expressions such as "according to an embodiment of the invention" or the like are used herein, these phrases are meant to generally reference embodiment possibilities, and are not intended to limit the invention to particular embodiment configurations. As used herein, these terms can reference the same or different embodiments that are combinable into other embodiments.

Methods for using the apparatus are also contemplated. For example, a method for passively recirculating exhaust gas in a gasoline or diesel engine can include receiving exhaust gas 104 from an exhaust manifold or exhaust system 604 of an engine 602 at an input 132 of an exhaust gas re-induction apparatus 100, recirculating a first quantity of exhaust gas 118 to an air inlet 606 of the engine 602 when the operating speed of the engine 602 corresponds to an idling speed, recirculating a second quantity of exhaust gas 118 to the air inlet 606 of the engine 602 when the operating speed of the engine 602 corresponds to a second operating speed greater than the idling speed, and recirculating a third quantity of exhaust gas 118 to the air inlet 606 of the engine 602 when the operating speed of the engine 602 corresponds to a third operating speed greater than each of the idling speed and the second operating speed. The second quantity of exhaust gas is greater than the first quantity of exhaust gas, and the third quantity of exhaust gas is greater than each of the first and second quantities of exhaust gas, when measured in each state over a particular period of time. The quantities of exhaust gas recirculated to the air inlet 606 of the engine 602 from the re-induction apparatus 100 can be essentially or entirely dependent on the operating speed of the engine 602 and the size dimensions of the re-induction apparatus 100. Methods of operating, constructing, and using any of the components described herein such as the exhaust gas re-induction apparatus 100 within an exhaust gas passive re-induction system 600 are also contemplated and set forth herein.

Consequently, in view of the wide variety of permutations to the embodiments described herein, this detailed description and accompanying material is intended to be illustrative only, and should not be taken as limiting the scope of the invention.

What is claimed is:

1. An exhaust gas re-induction apparatus, comprising:

an inner conduit structured to transfer exhaust gas in a first direction;

a central conduit concentrically arranged relative to the inner conduit, the central conduit structured to guide a first portion of the exhaust gas in a second direction opposite the first direction;

an outer housing coupled to the inner and central conduits, and concentrically arranged relative to the inner and central conduits, the outer housing structured to receive the first portion of the exhaust gas from the central conduit through a plurality of orifices disposed in the central conduit; and a return conduit structured to receive the first portion of the exhaust gas from the plurality of orifices, and to guide the first portion of the exhaust gas to an exhaust system of an engine, wherein the inner conduit is structured to pass a second portion of the exhaust gas for recirculation to the engine.

2. The exhaust gas re-induction apparatus of claim 1, wherein:

the inner and central conduits are substantially cylindrical and extend beyond the ends of the outer housing;

inner walls of the central conduit are equidistant to outer walls of the inner conduit; and an exhaust gas input of the central conduit is proximally located to an exhaust gas output of the inner conduit.

3. The exhaust gas re-induction apparatus of claim 1, wherein a diameter of a cross section of the inner conduit is less than a diameter of a cross section of the central conduit, and the inner conduit extends through the central conduit for at least the length of the central conduit.

4. The exhaust gas re-induction apparatus of claim 1, wherein:

the outer housing forms a heat exchange chamber between inner walls of the outer housing and outer walls of the central conduit;

the inner conduit, the central conduit, and the outer housing are structured to exchange heat one with another and with the atmosphere external of the re-induction apparatus, and are structured to alter the temperature of the exhaust gas based on the quantity of exhaust gas flowing therein; and the return conduit is coupled to an input of the inner conduit and structured to return at least a portion of the temperature altered exhaust gas to the inner conduit.

5. The exhaust gas re-induction apparatus of claim 1, further comprising:

a recirculation conduit coupled to an end of the central conduit, the recirculation conduit surrounding a terminal end portion of the inner conduit, and structured to receive and transfer the second portion of the exhaust gas to the engine for recirculation of the second portion of the exhaust gas.

6. The exhaust gas re-induction apparatus of claim 5, wherein the second portion of the exhaust gas transferred through the recirculation conduit corresponds to between about 5% (percent) to 20% (percent) of the total exhaust gas produced by the engine over a given period of time, thereby increasing the fuel efficiency and reducing the emissions of the engine.

7. The exhaust gas re-induction apparatus of claim 1, wherein the quantity of exhaust gas passed through the inner conduit for recirculation in the engine and the quantity of gas exhaust transferred through the return conduit are essentially dependent only on the operating speed of the engine and the size dimensions of the re-induction apparatus.

8. The exhaust gas re-induction apparatus of claim 7, wherein each component of the exhaust gas re-induction apparatus is passive and non-controlled.

9. The exhaust gas re-induction apparatus of claim 7, wherein the inner conduit, the central conduit, the outer housing, and the return conduit have always-open passages in which the exhaust gas can flow at different rates depending on the operating speed of the engine and the size dimensions of the inner conduit, the central conduit, the outer housing, the return conduit, and each of the plurality of orifices.

10. The exhaust gas re-induction apparatus of claim 1, wherein:

the outer housing is substantially bell-shaped including at least a first section having a first diameter and a second section having a second diameter, wherein the walls of the outer housing are tapered between the first and second sections; and the plurality of orifices are spaced apart one from another and circumferentially disposed around a section of the central conduit, wherein the section having the circumferentially disposed orifices is located toward an end of the central conduit opposite an exhaust gas output of the inner conduit.

11. The exhaust gas re-induction apparatus of claim 10, wherein:

the central conduit includes an annular shaped exhaust gas input offset from the exhaust gas output of the inner conduit;

the inner conduit includes an exhaust gas input structured to be coupled to the exhaust system of the engine;

the return conduit is structured to be coupled to the exhaust system of the engine via a connecting conduit;

the connecting conduit includes a one-way valve structured to permit one-way passage of the first portion of the exhaust gas to the exhaust system;

an end of the central conduit associated with the exhaust gas input of the central conduit is structured to be coupled to a recirculation conduit; and the exhaust gas output of the inner conduit is structured to be contained within the recirculation conduit for recirculation of the second portion of the exhaust gas through the engine.

* * * * *